US007627914B2

(12) United States Patent
Branch, III

(10) Patent No.: US 7,627,914 B2
(45) Date of Patent: Dec. 8, 2009

(54) HAMMOCK STAND

(75) Inventor: Jesse A. Branch, III, Winterville, NC (US)

(73) Assignee: Hatteras Hammocks, Inc., Greenville, NC (US)

( * ) Notice: Subject to any disclaimer, the term of this patent is extended or adjusted under 35 U.S.C. 154(b) by 0 days.

(21) Appl. No.: 12/164,149

(22) Filed: Jun. 30, 2008

(65) Prior Publication Data

US 2009/0000029 A1 Jan. 1, 2009

Related U.S. Application Data

(60) Provisional application No. 60/947,103, filed on Jun. 29, 2007.

(51) Int. Cl.
*A45F 3/22* (2006.01)

(52) U.S. Cl. ..... 5/129; 5/127; 5/122

(58) Field of Classification Search ..... 5/127–129, 5/120, 122

See application file for complete search history.

(56) References Cited

U.S. PATENT DOCUMENTS 3,757,361 A * 9/1973 Harris et al. ..... 5/184
5,153,955 A * 10/1992 Singleton et al. ..... 5/127

* cited by examiner

*Primary Examiner*—Fredrick Conley
(74) *Attorney, Agent, or Firm*—Ward and Smith, P.A.

(57) ABSTRACT

An easy to assemble hammock stand is made up of three support members which are connected together. To facilitate connection, plates are located at each end of the support members which include a base and two upwardly extending end members having a plurality of key slot shaped openings with an upward larger entry section. The other of the members to be connected to the key slot shaped opening include corresponding lugs with large head portions which fit in through the larger portion of the key slot openings and then slidably engage securely in a narrower portion of the key slot opening to hold the three members together. Foot members are connected at the joints between the hammock stand member and connected with a combination of a similar key slot shaped arrangement, and conventional screws. The hammock stand components are preferably made of light weight metal tubing and covered with a covering such as wicker mesh.

11 Claims, 5 Drawing Sheets

HAMMOCK STAND

CROSS REFERENCE TO RELATED APPLICATIONS

This application is related to U.S. Provisional Application Ser. No. 60/947,103 filed Jun. 29, 2007 entitled WOVEN WICKER HAMMOCK STAND, the disclosure of which is incorporated in its entirety by reference herein. Applicant claims priority to the filing date of Jun. 29, 2007 of said provisional application.

FIELD OF THE INVENTION

The invention relates to a stand for supporting a hammock in a suspended state above the ground. More particularly, the invention relates to such a stand which is made of light weight material, is easy to assemble and compact in size and weight when disassembled, while providing a sturdy, strong structure which can be easily moved when assembled. The invention also relates to a kit for making such a stand.

BACKGROUND OF THE INVENTION

Hammocks are a popular form of outdoor leisure furniture. One way of supporting hammocks is by connection to two closely located trees or posts. However, connection to trees or fixed posts limits the available locations where a hammock may be supported. More particularly, often the environments in which the use of hammocks is most desirable, such as the beach or an open sunny area of the yard, are generally lacking in suitable structures to which the ends of hammocks can be attached.

One solution in the past is to create a device which provides the necessary structure for suspending a hammock from its two ends so that it is maintained in a state where it swings freely above the ground. One requirement for such structures is that they must be quite large since they must accommodate a fully extended hammock in a supported manner, including a reasonable length of rope or chain at either end to permit the hammock to be suspended in a comfortable position for a user, and to allow the hammock to swing freely.

Typically, prior art hammock stands have generally been large bulky devices, which for shipping purposes must also be capable of being assembled and disassembled. In this regard, a typical prior art configuration is a large elongate arch which stands upright on the ground and supports a hammock between its two ends. In the past such devices have been constructed of a large number of pieces which require bolting together to form an inverted arch. A typical construction includes two curved end sections which are joined by a pair of parallel elongate central pieces to form the inverted arch.

However, such constructions have the disadvantage that each of the respective two sections must be of considerable length in order to provide a sufficiently large structure to accommodate and support a hammock. They are also heavy and require complex bolt arrangements to assemble.

For the above reasons, what is needed is a stand for a hammock which combines the features of attractiveness with physical strength, ease of assembly, and compactness of size and weight in a disassembled state.

SUMMARY OF THE INVENTION

The present invention provides an improved hammock stand or a kit for a hammock stand which includes a generally horizontally extending base member. First and second upwardly extending end members are connected at respective ends of the generally horizontally extending base member to extend coaxially therewith. Connecting plates are provided at connecting ends of the base member and the first and second upwardly extending end members for connecting the first and second upwardly extending end members to the base member. A first plate on one of the members includes at least two key slot shaped openings, each having a larger section extending into a narrower slot. A complementary plate on the other member to be connected includes at least two lugs extending therefrom at positions aligned with the key slot shaped openings. The lugs have head portions of a size which fit in the larger section of the key slot shaped opening but not through the narrower slot, with the lugs received in the openings and engaged within the narrower slots for holding the members together. A pair of foot members or supports are detachably connected respectively at the connection of each of the upwardly extending end members to the base member.

In an exemplary embodiment, the foot members also include a plate having at least one key slot shaped opening with the larger section extending into a narrower slot. The plate is located to be in contact with the base member and an upwardly extending end member connected thereto. The base member or the upwardly extending end member connected thereto also has a plate with at least one lug having a head portion of a size which fits in the larger portion of the key slot shaped opening on the foot member to be received within the foot plate key slot shaped opening, and engaged within the narrow slot. The other one of either the base member or the upwardly extending end member also includes a plate with a screw receiving opening located to be aligned with oval openings on the foot member plate to be secured together through engagement with a screw.

In a preferred aspect, the base member has a slight curvature for being connected to the upwardly extending end members in a manner to be coaxially coextensive therewith. More specifically, the first and second upwardly extending end members are curved such that when connected together with the base member, form a unitary elongate hammock support in the shape of an upturned arch.

In a further exemplary embodiment, the components are made of hollow metal tubing with a woven wicker covering.

These and other advantages and features that characterize the invention are set forth in the claims annexed hereto and forming a further part hereof. However, for a better understanding of the invention and of the advantages and objectives obtained through its use, reference should be made to the Drawings and to the accompanying descriptive matter in which there are described exemplary embodiments of the invention.

DETAILED DESCRIPTION OF THE INVENTION

Figure 1:
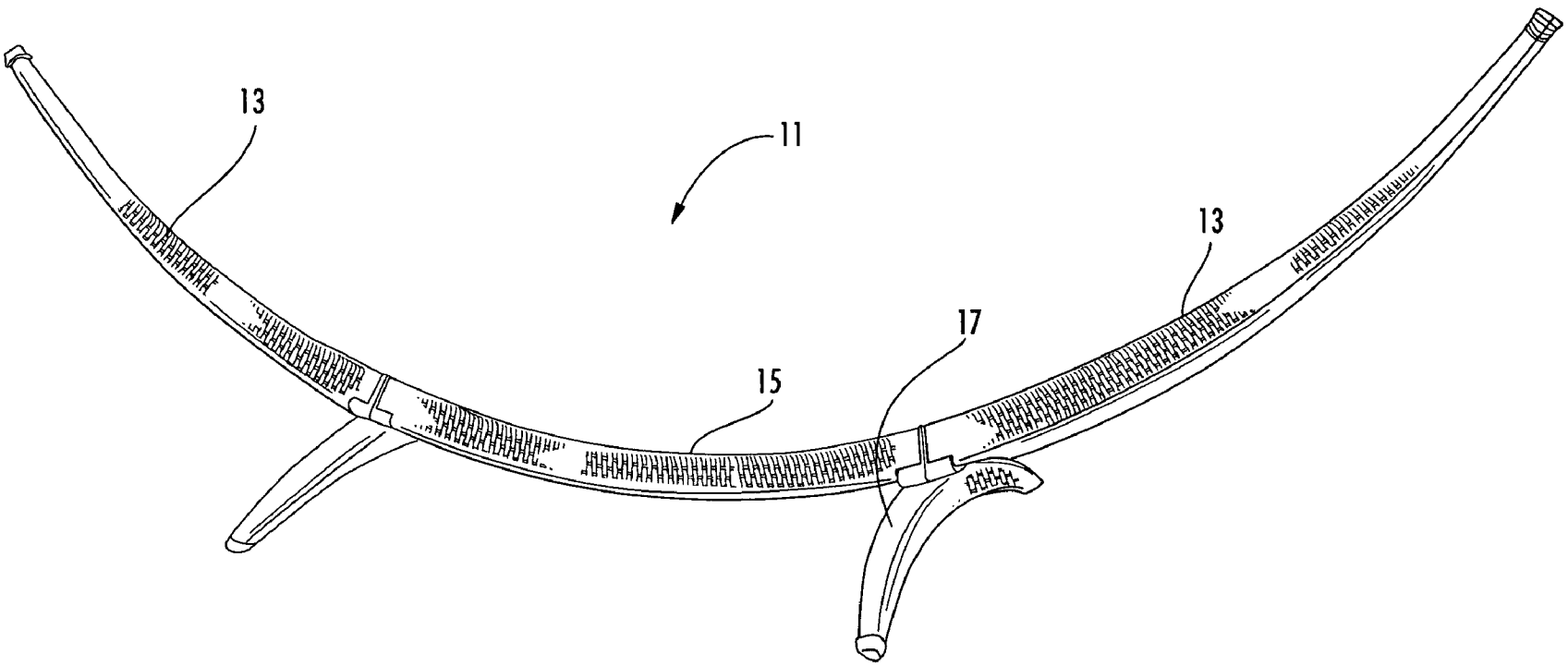
FIG. 1 is a perspective view of an assembled hammock stand of the invention.

FIG. 1 shows in perspective view an assembled hammock stand 11 in accordance with the invention. A central base member 15 is connected to two upwardly extending end members 13. As will be appreciated from a viewing of the drawing, the central base member 15 can be slightly curved as can the end members 13 such that when connected, they extend coextensively coaxially to form an upturned or inverted arch. Foot members 17 support the hammock stand 11 by being connected typically at the junction between the base member 15 and upwardly extending end members 13.

Figure 2:
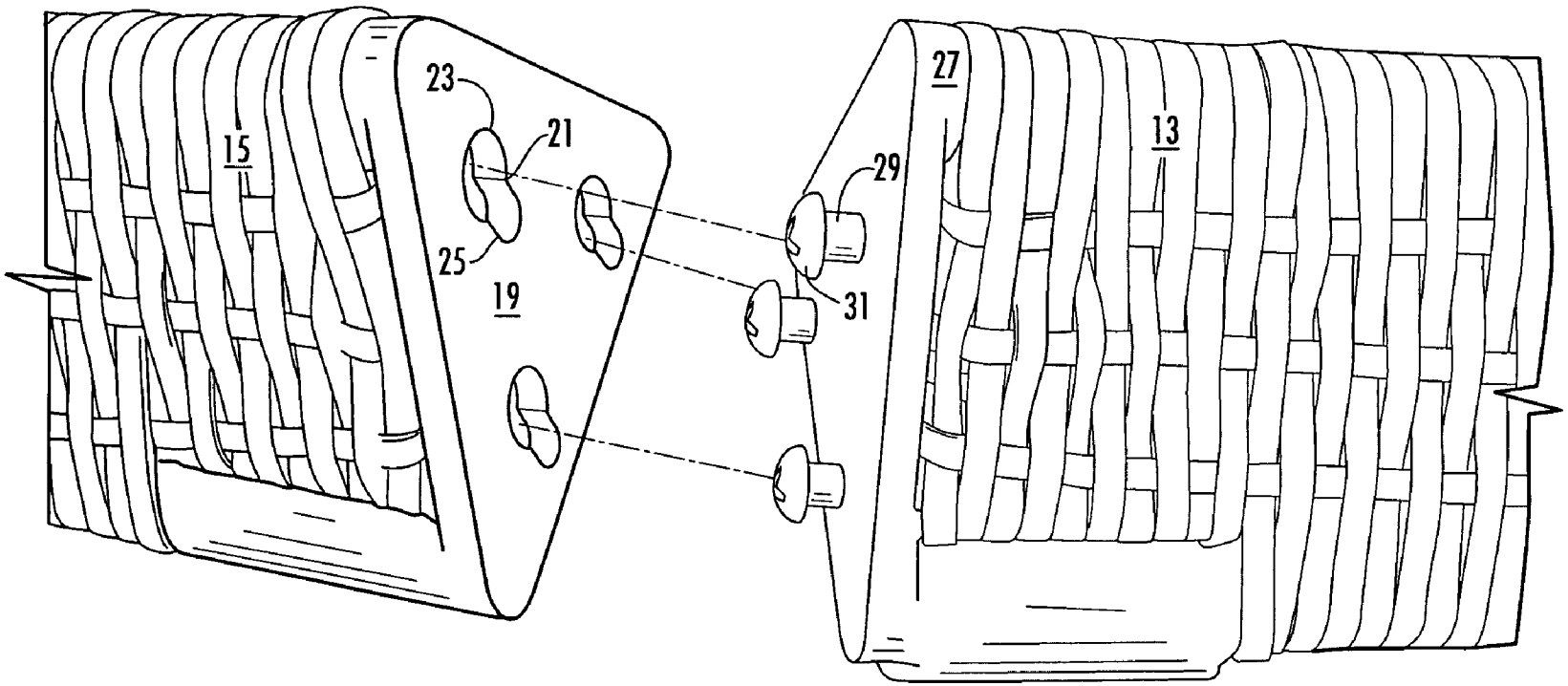
FIG. 2 is disassembled perspective view showing the connecting ends of a base member and upwardly extending end member.

FIG. 2 illustrates in greater detail the connection between the base member 15 and the upwardly extending end member 13. More specifically, as illustrated in FIG. 2, in an exemplary embodiment, the upwardly extending end members 13 include a plate 27 including lugs 29 which have a larger head portion 31 on the lugs 29. The base member 15 includes a plate at the end 19 having key slot shaped openings 21, including a larger portion 23, and with elongate slots 25 extending from the larger portion 23. In a preferred embodiment, three openings 21 are provided to connect with a corresponding number of lugs 29. As will be readily appreciated, the head portion 31 fits into the larger portion 23 of opening 21 and is allowed to settle by gravity or force into the narrow slot 25 to be held securely therein. While the key slots are shown on a plate for the base member and the lugs on a plate for the upwardly extending end members, it will be readily apparent that the arrangement can be reversed and still provide the same or like functionality.

Figure 3:
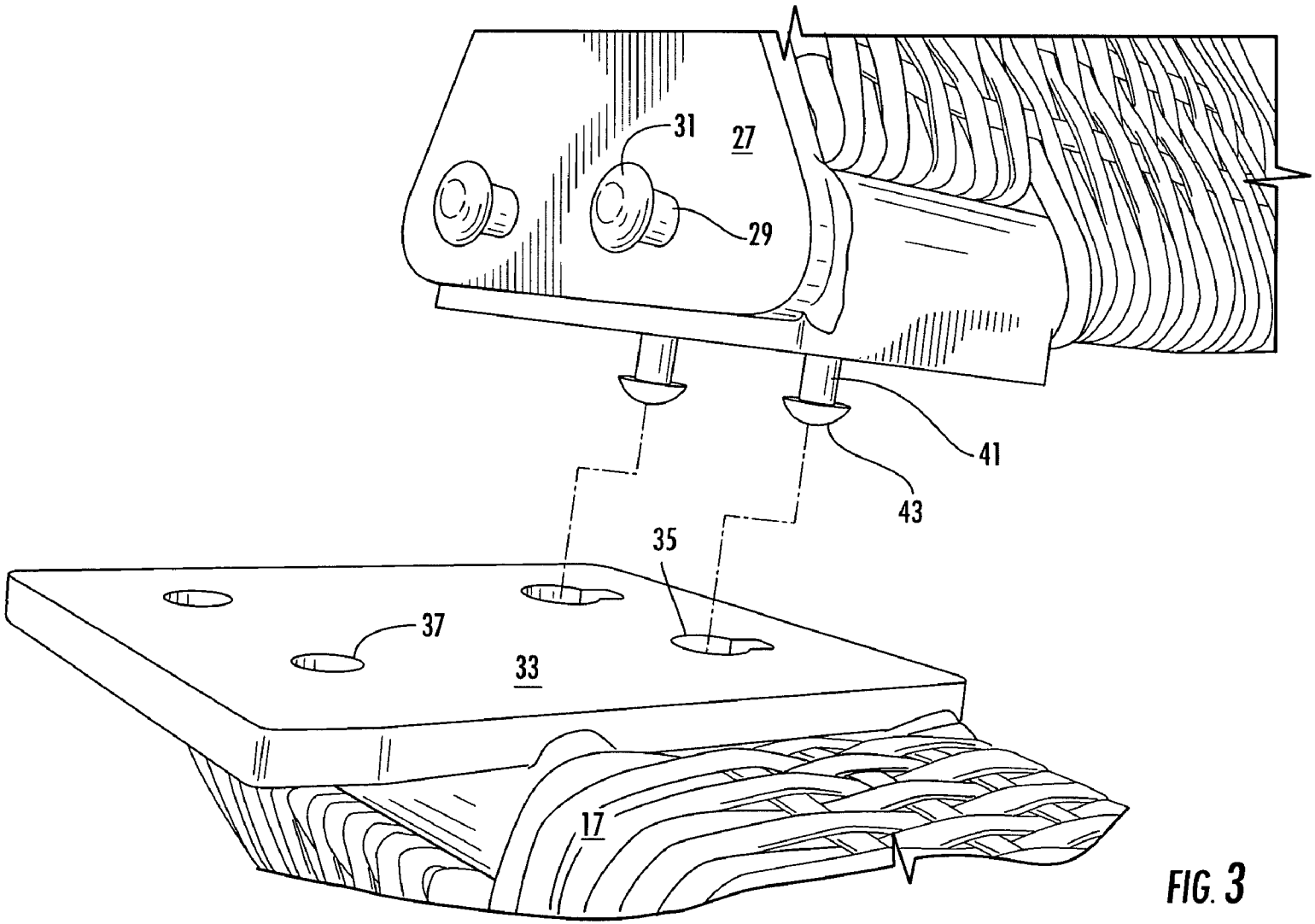
FIG. 3 is an alternate partial disassembled and perspective view showing an end of an upwardly extending end member to be assembled onto a foot member.
Figure 4:
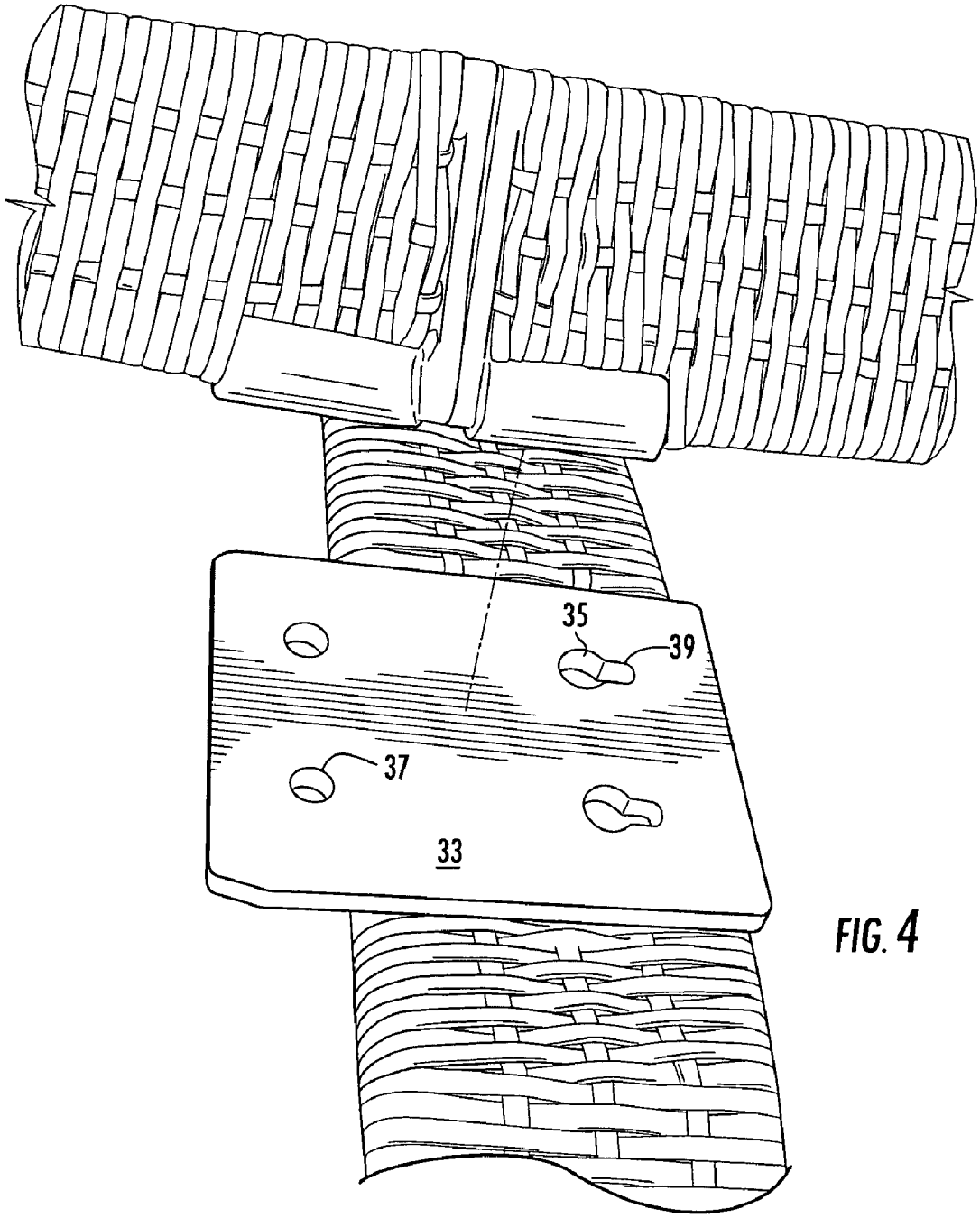
FIG. 4 is a partial disassembled perspective view showing an assembled base and upwardly extending end member in position for connection to a foot member.

The connection between assembled base member 15, upwardly extending end members 13, and foot members 17 is shown in greater detail in FIGS. 3 and 4. Foot members 17 may include a plate 33 having a pair of key slot shaped openings 35 each having an elongate slot 39 extending downwardly therefrom. Another pair of openings 37 on the plate 33 are circular or oval in shape. As shown in FIG. 3, plate 27 of the upwardly extending member 13 may also include downwardly projecting lugs 41 with a larger head 43 which is received in the larger portion of openings 35, and then by slidingly engaging towards the direction of the narrow slot 39, a secure connection can be established.

Of course, as will be appreciated, this assembly is done after the base member 15 has been assembled with the end members 13. The base member 15 may also include a bottom plate 61 (FIG. 6) with screw receiving openings 63 which align with openings 37 of plate 33 once lugs 41 are securely engaged within key slot openings 35, to allow the entire assembly to be secured through the use of screws 51 as will become more readily apparent from the discussion of FIGS. 5-7 herein.

Figure 5:
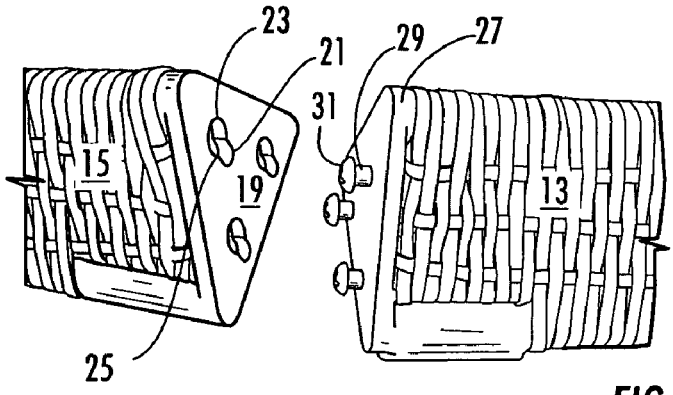
FIG. 5 is a perspective view illustrating how a base member and upwardly extending end member may be connected together.

FIG. 5 illustrates in perspective view the alignment between end member 13 and base member 15, such that lugs 29 can be received within key slot openings 21.

Figure 6:
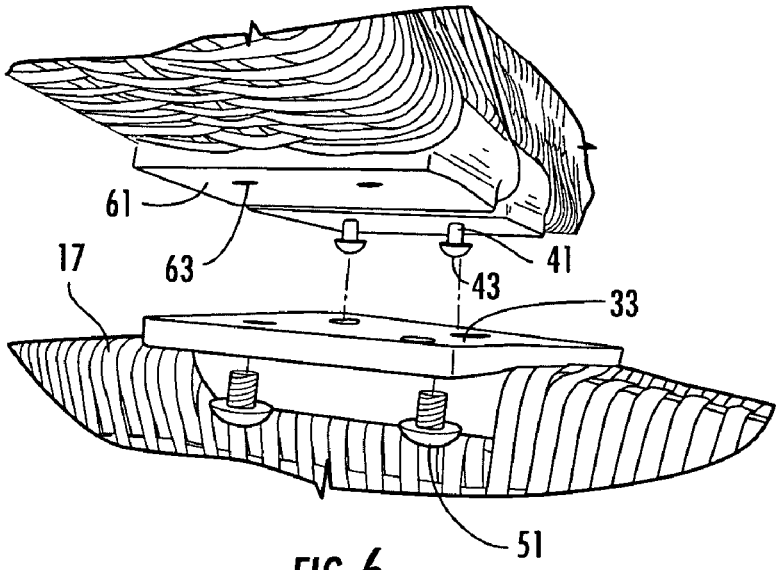
FIG. 6 is a perspective view illustrating how an assembled base member and upwardly extending end member connected thereto may be connected to a foot member.
Figure 7:
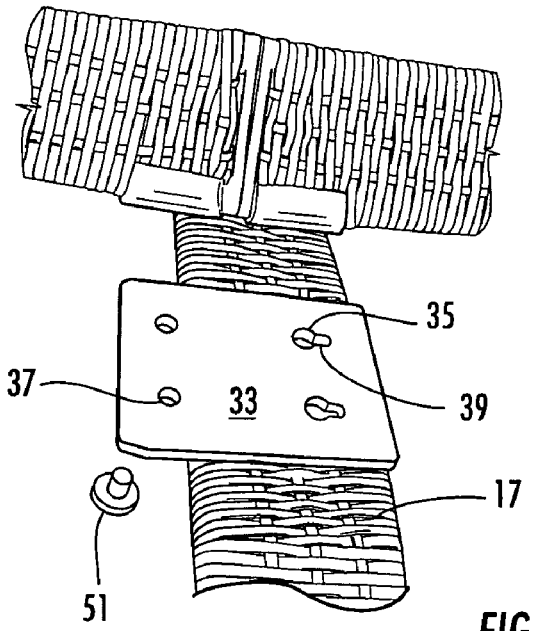
FIG. 7 is an alternative view to that of FIG. 6, showing how an assembled base member and upwardly extending end member may be assembled onto a foot member.

Once the base member 15 and end members 13 are assembled, as shown in FIGS. 6 and 7, downwardly extending lugs 41 having a larger head 43 can be received within openings 35 and slid into engagement within slot 39 of plate 33, which is part of the foot member 17. By such slidable engagement, openings 37 can be aligned with corresponding openings 63 of the assembled base 15 and upwardly extending members 13 such that screws 51 can be used to secure the entire assembly in a simple and easy manner. Of course, as in the case with the plates connecting the base member and end members, the various configurations can be altered to allow, for example, lugs 41 to extend from the base member 15, with openings 63 arranged on the end members 13 as will be readily apparent to one of ordinary skill.

Thus, as might be appreciated, a simple to assemble and sturdy hammock stand 11 is provided in accordance with the invention. Preferably, the various components are made of light weight tubing such as light weight hollow metal tubing of aluminum or like materials. For decorative and functional weight-saving purposes, it is preferred that the various components be covered in wicker mesh.

In another aspect, the invention may be provided as a kit for assembling such a hammock 11 with each of the individual components packaged together with appropriate instructions.

While the present invention is illustrated by a description of various embodiments and while these embodiments have been described in considerable detail, it is not the intention of the applicant to restrict, or in any way limit, the scope of the appended claims to such detail. The invention in its broader aspects is therefore not limited to the specific details, representative apparatus and method, an illustrative example shown and described. Accordingly, departures may be made from such details without departing from the spirit or scope of applicant's general inventive concept.

What is claimed is:

1. A stand for supporting a hammock, comprising:

a generally horizontally extending base member;

first and second upwardly extending end members connected at respective ends of said generally horizontally extending base member to extend coaxially therewith;

connecting plates at connecting ends of said base member and said first and second end members for connecting said first and second end members to said base member, a first plate on a respective one of the first and second end members and the base member comprising at least two key slot shaped openings adjacent each other, each opening having a larger section extending into a narrower slot, and a second complementary plate on the other of said members, and having at least two lugs extending therefrom at positions aligned with said key slot shaped openings, said lugs having a head portion of a size which fits in the larger section of said key slot shaped openings but not through said narrower slot, with said lugs received in said key slot openings and engaged within said narrower slots for holding said base member and end members together in a manner wherein said base member can be secured to said first and second end members in fixed and non-rotational alignment along an axis thereof; and a pair of foot members detachably connected respectively at the connection of each of the upwardly extending end members to the base member.

2. The stand according to claim 1, wherein said foot members further comprise:

a plate having at least one key slot shaped opening having a larger section extending into a narrower slot and at least one generally shaped circular opening; said plate located in contact with said base member and a connected end member;

one of said base member and end member having a plate with at least one lug having a head portion of a size which fits in the larger section of the key slot shaped opening but not through the narrow slot, and extending in a direction to be received within the foot plate key slot shaped opening and engaged within the narrower slot; and the other said base member and end member having a plate with screw receiving openings located to be aligned within said circular opening on said foot member plate and secured together through engagement with a screw.

3. The stand of claim 1, wherein said at least two key slot shaped openings comprise three key slot shaped openings, and said at least two lugs comprise three lugs corresponding to said three key slot shaped openings.

4. The stand of claim 2, wherein said at least one key slot shaped opening comprises two key slot shaped openings, said at least one generally shaped circular opening comprises two generally shaped circular openings, and said at least one lug comprises two lugs.

5. The stand of claim 1, wherein said base member has a slight curvature for being connected to said first and second upwardly extending end members in a manner to be coaxially coextensive therewith.

6. The stand of claim 1, wherein said base member and first and second end members are curved such that when connected together form a unitary elongate member in the shape of upturned arch.

7. The stand of claim 1, wherein said foot members are connected to be oriented transverse to the base member and the first and second end members.

8. The stand of claim 1, wherein said base member and first and second end members are made of hollow metal tubing with a woven wicker covering.

9. The stand of claim 1, wherein said foot members are elongate and serve as supports for said stand.

10. The stand of claim 9, wherein said foot members are made of hollow metal tubing with a woven wicker covering.

11. A kit for assembling a hammock stand, comprising:

a generally horizontally extending base member;

first and second upwardly extending end members connectable to respective ends of said generally horizontally extending base member to extend coaxially therewith;

connecting plates at connecting ends of said base member and end members respectively, one plate at a connecting end having at least two key slot shaped openings adjacent each other, each opening having a larger section extending into a narrower slot, another complementary plate at a complementary connecting end having at least two lugs with a head portion of a size to fit into the larger section of the key slot shaped opening for sliding into the narrower slot to be held therein when connected in a manner wherein said base member can be secured to said first and second end members in fixed and non-rotational alignment along an axis thereof; and a pair of foot members connectable respectively at a connection of each of the end members to the base members when assembled.

* * * * *